US005611638A

United States Patent [19]

Dörr et al.

[11] Patent Number: 5,611,638

[45] Date of Patent: Mar. 18, 1997

[54] CONNECTING DEVICE FOR SELECTIVELY CONNECTING A PATIENT SUPPORT MEANS WITH THE SUPPORT COLUMN OF AN OPERATING TABLE

[75] Inventors: Holger Dörr, Rastatt; Hermann Kieferle, Gaggenau, both of Germany

[73] Assignee: Stierlen-Maquet AG, Rastatt, Germany

[21] Appl. No.: 496,082

[22] Filed: Jun. 28, 1995

[30] Foreign Application Priority Data

Jul. 4, 1994 [DE] Germany ..... 44 23 374.4

[51] Int. Cl.[6] ..... A47C 19/00

[52] U.S. Cl. ..... 403/327; 403/321; 5/81.1 R

[58] Field of Search ..... 403/327, 326, 403/321, 331; 5/86, 81, 65, 63, 60, 81.1 R, 86.1; 269/322, 323

[56] References Cited

U.S. PATENT DOCUMENTS 4,197,855 4/1980 Lewin ..... 128/653
4,858,622 8/1989 Osterweil ..... 128/782
5,083,331 1/1992 Schnelle et al. ..... 5/60
5,107,855 4/1992 Harrington et al. ..... 128/722

*Primary Examiner*—Anthony Knight
*Attorney, Agent, or Firm*—McCormick, Paulding & Huber

[57] ABSTRACT

At least two connecting elements are fastened to the patient support and are insertable into pin receivers of the column and carriage. Each connecting element has two latching elements each movable between a latching position and an unlatching position, and during relative movement between the transport carriage and the support column resulting in the transfer of the patient support from the column to the transport carriage, or the reverse, each connecting element becomes received at the same time in a column pin receiver and a carriage pin receiver. Each receiver has a detent recess for receiving one of the latching elements of a received connecting element in its latching position and a control surface associated with the other latch element of the received connecting element which control surface upon the reception of the connecting element transfers this latching element to its unlatched position. Each of the latching elements has associated with it a sensor for detecting the latching position of the latching element.

2 Claims, 3 Drawing Sheets

CONNECTING DEVICE FOR SELECTIVELY CONNECTING A PATIENT SUPPORT MEANS WITH THE SUPPORT COLUMN OF AN OPERATING TABLE

FIELD OF THE INVENTION

The invention concerns a connecting device for selectively connecting a patient support means with the support column of an operating table or with a transport carriage, including at least two pin shaped connecting elements for fastening to the patient support means and insertable into pin receivers of the support column or carriage with at least two latching elements on each of the connecting elements each of which latching elements is so movably supported as to be adjustable between a latching position and an unlatching position, and wherein through relative movement between the transport carriage and the support column resulting in the transfer of the patient support means from the column to the transport carriage, or the reverse, each connecting element is received at the same time in a column pin receiver and a carriage pin receiver, each receiver further having formed therein a detent recess for receiving one of the latching elements in its latching position and also having a control surface associated with the other latching element of said received connecting element, which control surface upon reception of the connecting element by the receiver transfers this other latching element to its unlatched position, and wherein when a connecting element is received at the same time by two receivers each latching element of the so received connecting element has associated with it the detent recess of one of said two receivers and the control surface of the other of said two receivers.

BACKGROUND OF THE INVENTION

Such a connecting device is known from U.S. Pat. No. 5,083,331 DE-A-40 15 471, the content of which publication is to its full extent incorporated into this application. This connecting apparatus offers the possibility, by solely through a vertical relative movement between the support column of an operating table and a transport carriage, for a patient support means to be transferred from the transport carriage to the support column, or the reverse, wherein before the transfer a control surface on the pin receiver of the receiving component (support column or transport carriage) unlatches a latching element at the delivering component (transport carriage or support column), and wherein after the transfer by means of a control surface on the pin receiver of the delivering component (transport carriage or support column) a latching element at the receiving component (support column or transport carriage) is latched.

The invention has as its object to so form a connecting device of the previously mentioned type that increased security is obtained during the transfer of the patient support means from one support apparatus to another.

SUMMARY OF THE INVENTION

This object is solved in accordance with the invention in that each of the latching elements has associated with it a sensor for detecting the latched position of the latch element. The sensors can each be connected with an indicating device in order to indicate to the operator, and thereby to provide the assurance, that the involved latching element is actually latched and that some unintended release of the patient support means from the support apparatus is impossible. There exists also the possibility of having the sensors included in the control of a movement function of the operating table and to connect them with the control apparatus connected with the support column. So long as the latched position of an involved latch element is not detected by the associated sensor all movement functions of the patient support means are blocked by the control apparatus. The movement functions are then first enabled when the involved sensor sends a signal indicating that the associated latch element is found to be in its latched position. The sensors are practically arranged in the column pin receivers since the control apparatus for controlling the movement functions are generally to be found in the column.

In accordance with a practical embodiment the sensors each include a Hall-detector arranged in the column pin receivers and a magnet arranged in the associated latch element. This makes possible a contactless detection of the position of the latch element. The Hall-detector and the magnet can be embedded entirely in the supporting material so that they present no cleaning problem.

According to a preferred embodiment, the latch elements are made of pawls pivotally supported in the connecting element, each of which pawls has two sections one of which sections is adapted to be received in the latch recess of a pin receiver of the support column or of the transport carriage and the other of which is adapted to engage the control surface of the pin receiver of the other component (transport carriage, support column). In the carriage receiver between the point at the latch recess which lies opposite to the magnet in the latched position of the pawl, and the point which the Hall-detector upon latching of the pawl lies opposite to, a magnetic field transmitting device is arranged. Thereby larger freedom in the arrangement of the Hall-detector in the pin receiver of the support column is available. One such magnetic field transmitting device can for example be a soft iron element embedded in the carriage pin receiver.

Further features and advantages of the invention will be apparent from the following description which in connection with the accompanying drawings explain the invention by way of an exemplary embodiment.

DESCRIPTION OF THE PREFERRED EMBODIMENT

Figure 1B:
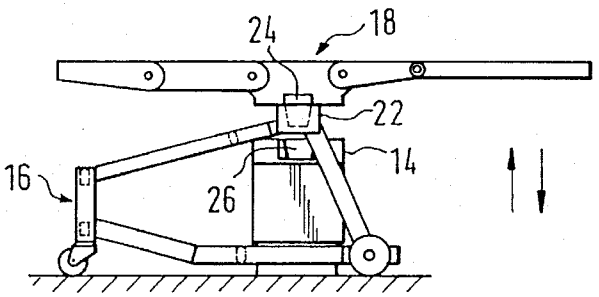
FIG. 1*a*, FIG. 1*b*, FIG. 1*c*, FIG. 1*d*, FIG. 1*e*, FIG. 1*f*, and FIG. 1*g*,—schematic sketches illustrating the transfer of a patient support means from a support column to a transport carriage, and the reverse, FIG. 2—a partially schematic perspective fragmentary illustration of a connecting device according to the invention with a connecting pin, a support column pin receiver and a transport carriage pin receiver, FIG. 3—a schematic cross-sectional view illustrating a connecting element latched into the pin receiver of the support column, FIG. 4—an illustration corresponding to FIG. 3 of a connecting element received in the pin receiver of the transport carriage, and FIG. 5—a schematic perspective illustration of the cooperation of a magnet with a Hall-detector through a magnetic field transmitting device.
Figure 1A:
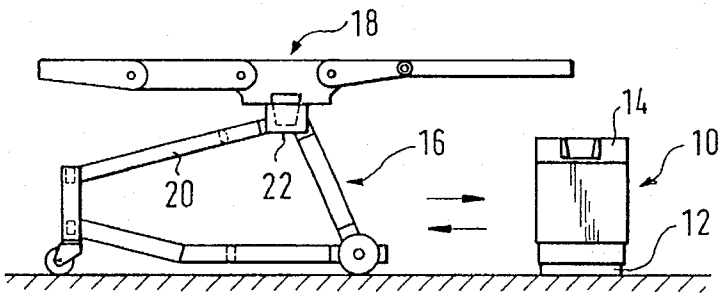

In FIG. 1*a* is seen the support column, indicated generally at 10, of an operating table with a column foot 12 and a column head 14 supported on the column foot 12 and adjustable in height. The height adjusting mechanism is not illustrated and can be provided in any customary way. In general it is an hydraulic or mechanical lifting apparatus.

Figure 1D:
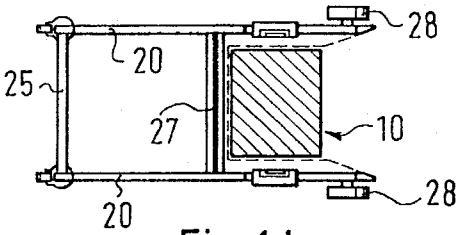
Figure 1C:
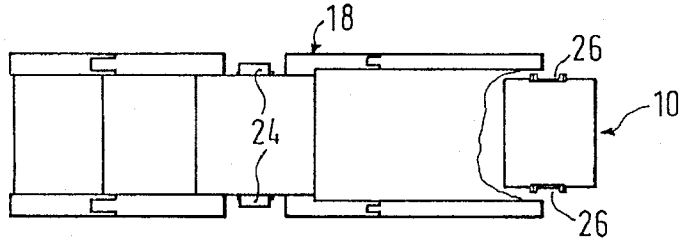

To the left and next to the support column is a transport carriage, indicated generally at 16, which carries the patient support means or table plate 18 of an operating table. The transport carriage 16 is made of two side frame portions 20 which are connected to one another by transverse spars (FIG. 1*d*). The transverse spars 25,27 are located in a middle region so that the space between the side frames 20 from the wheels 28 at the right end of the transport carriage in FIG. 1 to the transverse spars 25,27 is freely accessible. Thus the transport carriage can be so moved to the support column 10 that the support column becomes positioned between the frame portions 20, as seen in the schematic plan view of FIG. 1*d* of the transport carriage wherein the support column is illustrated in broken lines.

At the upper end of the somewhat nonsymetrically shaped side frames 20 are formed pin receivers 22 adapted for the reception of connecting elements 24 arranged on the longitudinal side edges of the table plate 18 and which extend downwardly from the table plate 18. The exact form of the connecting elements will be explained in more detail in connection with the other figures. At two oppositely directed sides of the column head 14 are likewise arranged pin receivers 26 so that they in the illustrated position of the transport carriage 16 relative to the support column 10 illustrated in FIG. 1*d* lie opposite to the pin receivers 22 of the transport carriage.

For the transfer of the table plate or patient support means 18 from the transport carriage 16 to the support column 10 the transport carriage 16 is moved to the position relative to the support column 10 illustrated in FIG. 1*b*. In this position the connecting elements 24 stand exactly above the pin receivers 26 on the column head 14. Next the column head 14 is lifted by the lifting apparatus inside of the column until the connecting elements 24 on the support surface means 18 are moved entirely into the pin receivers 26 on the column head 14.

At this time the connecting elements 24 are received at the same time in the pin receivers 22 of the transport wagon 16 and in the pin receivers 26 of the column head 14.

Figure 1G:
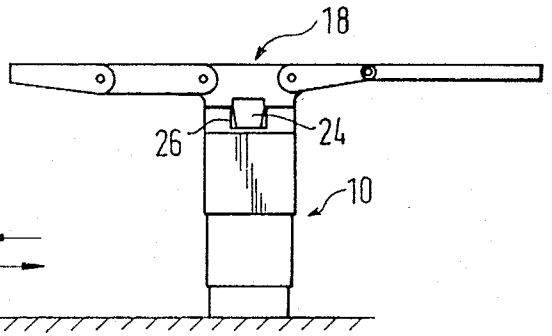
Figure 1F:
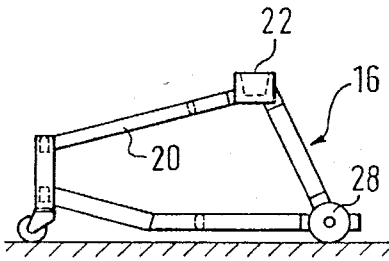
Figure 1E:
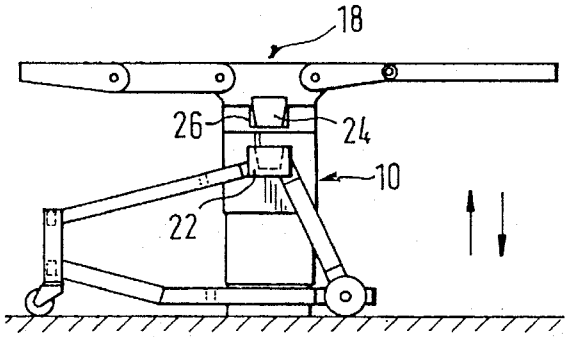

Now, in accordance with FIG. 1*e*, the column head 14 is further lifted until the patient support means 18 with its connecting elements 24 is lifted out of the pin receivers 22 of the transport carriage. The transport carriage can now be removed (FIG. 1*f*). The operating table can then in the customary way, according to need, be adjusted to the desired working height (FIG. 1*g*). In the transfer of the patient support means from the support column 10 to the transport carriage 16 a reverse procedure is carried out.

The patient support means 18 must be latched to the support column 10 as well as also to the support carriage 16 in order to prevent an unintended release of the support surface means from the particular support apparatus being used at the time. How this latching and unlatching during the transfer of the support surface means from the support column 10 to the transport carriage 16, or the reverse, takes place will now be described in more detail with reference to the further figures.

Figure 2:
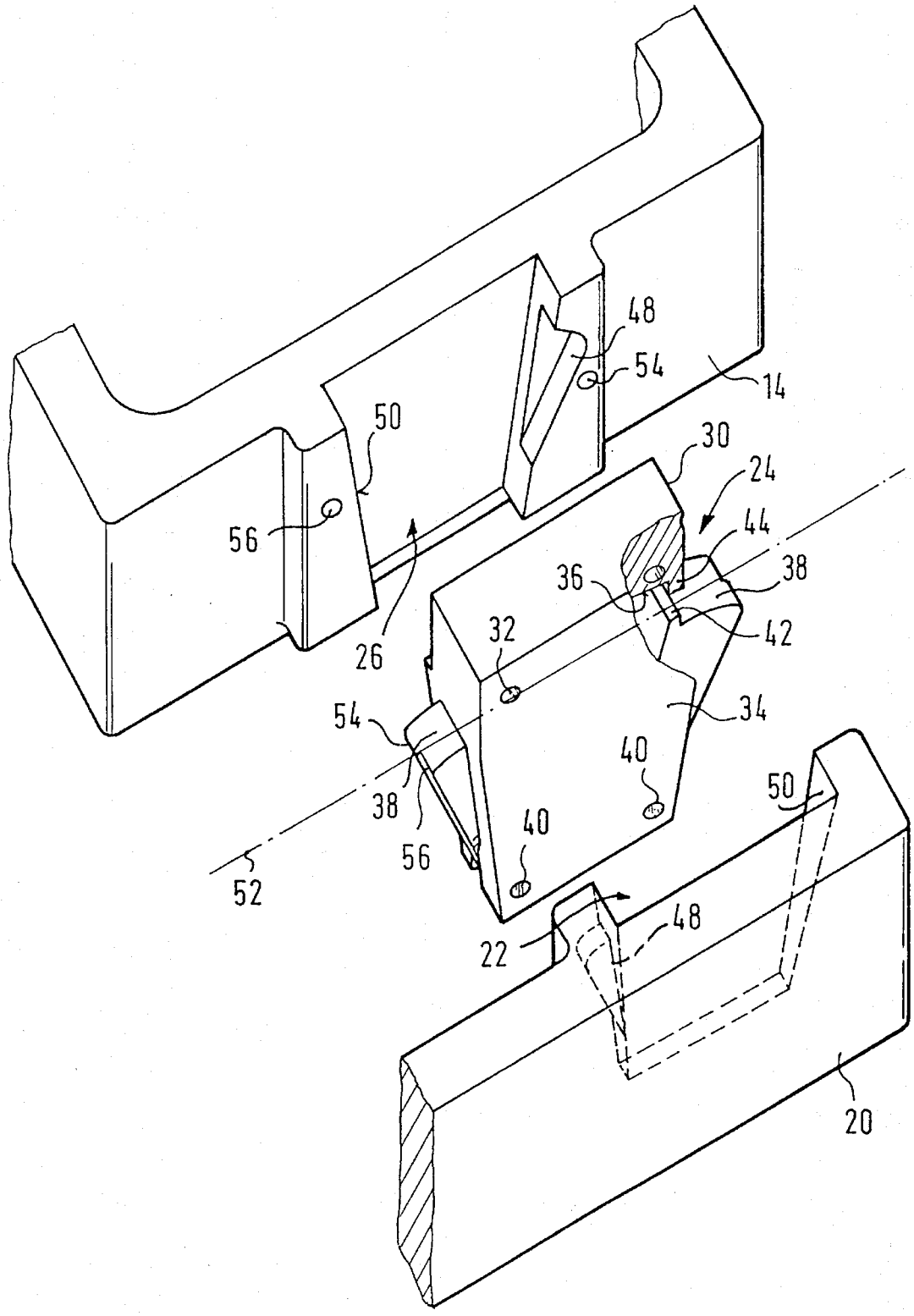
Figure 3:
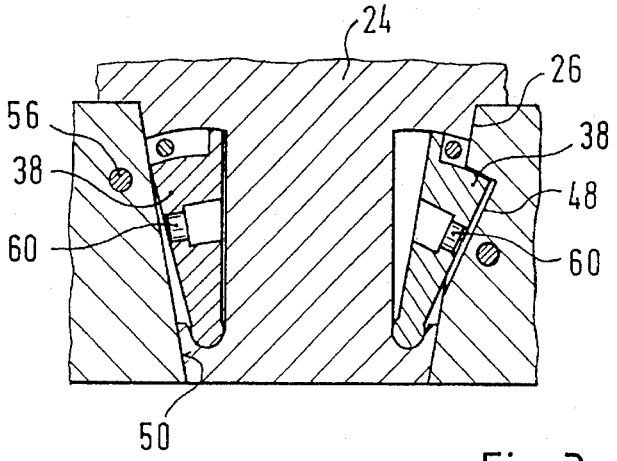
Figure 4:
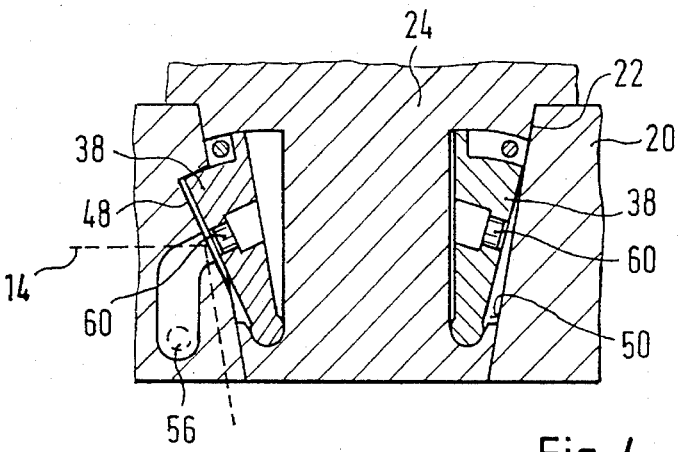

One connecting element 24 is illustrated in more detail in FIGS. 2–4. This connecting element comprises a block shaped flange portion 30 with bores 32 through which bolts for fastening the connecting element 24 to the patient support means 18 can be inserted. A trapezoidally shaped base body 34 is connected as one piece with the flange portion 30. The base body has on each of its front or small sides a forklike recess 36 in each of which a pawl 38 is pivotally supported about an axis 40. The pawls 38 have on their inwardly lying upper edges a stop 42 which prevents the outward pivoting of the pawl from the fork shaped recess 36 by engagement with a counterstop 44 of the base body 34, as can be seen in FIG. 3. Both pawls 38 are biased toward their outwardly pivoted positions by a nonillustrated helical compression spring working between them.

The pin receivers 22 on the transport carriage and the pin receivers 26 on the column head 14 are formed identically. They are suited in their shape to the base body 34 of the connecting elements 24, and each is adapted to surround a connecting element, however, only half way. The two open pin receivers 22 and 26 together form, with their open sides facing one another, a recess which entirely surrounds the associated connecting element 24. It is essential, however, that each pin receiver only on one of the side surfaces facing the front surfaces of the connecting element 22 have a pawl receiving or detent recess 48 while the other side face 50 is smooth and forms a control surface. If the connecting element is inserted into the pin receiver 26 of the column head (FIG. 3), the latching pawl 38 lying to the right in FIG. 3 can move into the associated detent recess 48. The left lying latching pawl 38 in FIG. 3 is pressed against the smooth control surface 50 against the force of the helical compression spring in the base body 34 of the connecting element 24 as illustrated in FIG. 3. It is to be noted that the pawls 38 in the direction of their axes extend only to the middle of the inner half of the pin receiver 26 of the column head. The plane normal to the axes up to which the connecting element 24 in the pin receiver 26 on the column head 14 lies is illustrated in FIG. 2 at 52.

FIG. 4 illustrates the other condition in which the connecting element 24 is received in the pin receiver 22 on the transport carriage 16. Here the left lying latching pawl 38 of FIGS. 2 and 4 moves into the provided detent recess 48 while the right latching pawl 38 is pressed by the smooth control surface 50 inwardly into the base body 34 of the connecting element 24. From the illustrations of FIGS. 3 and 4 it can be seen that the patient support means 18 is latched and thereby secured onto the column head 14 as well as onto the transport carriage 16.

In order to now be able to determine whether each of the latching pawls 38 is latched into its associated detent recess 48 sensors are provided. These include two Hall-detectors 54,56 arranged in bores in the column pin receivers as shown in FIGS. 2–4. In each pawl 38 is arranged a permanent magnet 60 in a bore 58. The arrangement of the magnet 60 in the latching pawl 38 adapted to be received in the detent recess of the column pin receiver 48 and of the associated Hall-detector 58 is so done that the Hall-detector 54 produces a signal as soon as the pawl 38 lies entirely in the detent recess 48, as illustrated in FIG. 3.

Figure 5:
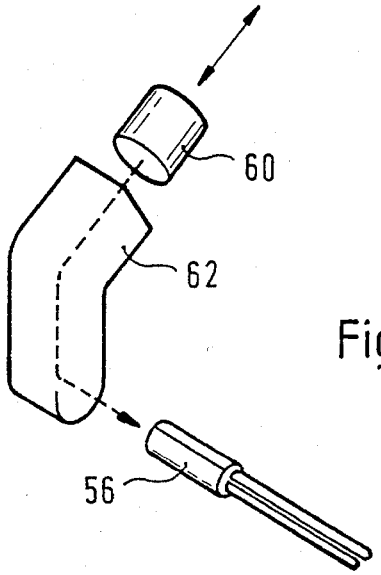

The case for the other latching pawl which is adapted to be received in the detent recess of the carriage pin receiver is somewhat more complicated. The magnet 60 is arranged in the same way as in the first described latching pawl 38. The Hall-detector 56 lies at a somewhat higher position with respect to the Hall-detector 54 in the column pin receiver. When the column 10 and with it the column pin receiver 26 in the transfer of the patient support surface means from the support column 10 to the transport carriage 16, is lowered with the latching pawls 38 transferring from the positions illustrated in FIG. 3 to the positions illustrated in FIG. 4 the pin receiver of the column 10 moves to the position illustrated by the broken lines in FIG. 4. Since the column pin receiver is removed thereby from the latching pawl 38 which latches into the carriage pin receiver a proximity between the Hall-detector 56 and the magnet 60 arranged in that latching pawl sufficient to produce a signal is not possible. Because of this, according to the illustration in FIGS. 4 and 5, between the magnet 60 arranged in the pawl and the Hall-detector 56 arranged in the column pin receiver a magnetic field transmitting element 62 is provided which connects a point 64, which lies opposite to the magnet 60 of the pawl 38 latching into the carriage receiver 22 and a point 66, which lies opposite to the Hall-detector 56 in the column pin receiver at this moment. This moment at which the latch pawl 38 reaches its latching position in the carriage pin receiver is illustrated in FIG. 4.

The magnetic field transmitting element 62 is for example a soft iron element.

The Hall-detectors are in a nonillustrated way either connected with an indicating device or with the control apparatus inside of the column 10 so that the latched condition is indicated or so that the control apparatus is informed of the latched condition.

With the solution of the invention it is possible to reliably determine that the latching pawls have reached their latching positions. Thereby the danger of an incomplete latching and of an unintended loosening of the patient support means from the support column or from the transport carriage can be avoided.

We claim:

1. A connecting device for selectively connecting a patient support means (18) with a support column (10) of an operating table or a transport carriage (16), including at least two pin shaped connecting elements (24) adapted for fastening to the patient support means (18), which connecting elements are insertable into pin receivers in the column and carriage, each of the connecting elements (24) having at least two latching elements (38) which are so movably supported as to be adjustable between a latching position and an unlatching position, and wherein through relative movement between the transport carriage (16) and the support column (10) resulting in the transfer of the patient support means from the column (10) to the transport carriage (16), or the reverse, each connecting element is received at the same time in a column pin receiver (26) and a carriage pin receiver (22), each pin receiver (26, 22) further having a detent recess (46) for receiving one of the latching elements (38) in its latching position and also having a control surface (50) associated with the other latching element (38) which control surface (50) upon reception of the connecting element (22) by the receiver transfers this other latching element (38) to its unlatched position, and wherein when a connecting element is received at the same time by two receivers each latching element (38) of the so received connecting element (24) has associated with it a detent recess (48) of one of said two receivers (26,22) (column, carriage) and the control surface (50) of the other of said two receivers (22,26) (carriage, column), characterized in that associated with each of the latching elements (38) is a sensor (54,56) for detecting the latching position of the associated latch element (38), each of the sensors includes a Hall-detector (54,56) which is arranged in the column pin receiver (26) and which is associated with a magnet arranged in one of the latching elements (38), the latching elements (38) are formed as pawls pivotally supported in the connecting element, each of which pawls has two sections of which one section is adapted to be received in the detent recess of a pin receiver (26,22) of the support column (10) or of the support carriage (16) and the other section of which is adapted to engage the control surface (50) of the pin receiver (22,26) of the other component (16,10), transport carriage, support column, and in that in the carriage pin receiver (22) between the point (64) at the detent recess (48) which lies opposite to the magnet 60 in the pawl (38) in the latching position of the pawl (38), and the point (66) which the Hall detector (56) lies opposite to upon latching of the pawl (38), a magnetic field transmitting device (32) is arranged.

2. A connecting device according to claim 1 further characterized in that the magnetic field transmitting device (62) is formed from a soft iron element connecting the two points (64,66) of the carriage pin receiver (22).

* * * * *